US006691976B2

(12) United States Patent
Myers et al.

(10) Patent No.: US 6,691,976 B2
(45) Date of Patent: Feb. 17, 2004

(54) ATTACHED PIN FOR POURED CONCRETE WALL FORM PANELS

(75) Inventors: Dallas E. Myers, Middletown, OH (US); James W. Jackson, Middletown, OH (US); John W. Poynter, Monroe, OH (US)

(73) Assignee: Feather Lite Innovations, Inc., Springboro, OH (US)

( * ) Notice: Subject to any disclaimer, the term of this patent is extended or adjusted under 35 U.S.C. 154(b) by 15 days.

(21) Appl. No.: 09/892,050

(22) Filed: Jun. 26, 2001

(65) Prior Publication Data

US 2002/0008188 A1 Jan. 24, 2002

Related U.S. Application Data

(60) Provisional application No. 60/214,338, filed on Jun. 27, 2000.

(51) Int. Cl.[7] ..... E04G 17/00

(52) U.S. Cl. ..... 249/191; 249/196

(58) Field of Search ..... 249/44, 45, 47, 249/191, 192, 196, 193, 194, 195

(56) References Cited

U.S. PATENT DOCUMENTS

| | | | | |
|---|---|---|---|---|
| 1,621,563 A | | 3/1927 | Stevens | |
| 1,641,927 A | * | 9/1927 | Gremel | 249/192 |
| 2,677,868 A | | 5/1954 | Banneyer | |
| 2,693,627 A | | 11/1954 | Banneyer | |
| 2,763,911 A | | 9/1956 | Rumble | |
| 2,871,619 A | | 2/1959 | Walters | |
| 3,010,175 A | | 11/1961 | Shoemaker | |
| 3,055,076 A | | 9/1962 | Van Helden et al. | |
| 3,204,918 A | | 9/1965 | Bonin et al. | |
| 3,211,413 A | | 10/1965 | Low, III | |
| 3,327,986 A | | 6/1967 | Oury | |
| 3,362,676 A | | 1/1968 | Bowden | |
| 3,432,137 A | | 3/1969 | Krajco | |
| 3,447,771 A | | 6/1969 | Trimmer | |
| 3,529,800 A | | 9/1970 | Gates | |
| 3,862,737 A | * | 1/1975 | Fuston, Jr. | 249/196 |
| 3,877,674 A | * | 4/1975 | Cerutti | 249/196 |
| 3,972,501 A | | 8/1976 | Plough | |
| 3,981,476 A | | 9/1976 | Alexander et al. | |
| 3,984,079 A | | 10/1976 | Gates | |
| 4,030,694 A | | 6/1977 | Schimmel | |
| 4,068,818 A | | 1/1978 | Gates | |
| 4,158,452 A | | 6/1979 | Gates | |
| 4,194,717 A | | 3/1980 | Easton et al. | |
| 4,210,305 A | | 7/1980 | Williams | |
| 4,211,385 A | | 7/1980 | Johanson et al. | |
| 4,239,173 A | | 12/1980 | Sawyer | |
| 4,280,677 A | | 7/1981 | Shahar | |
| 4,417,425 A | | 11/1983 | Case et al. | |
| 4,473,209 A | * | 9/1984 | Gallis et al. | 249/191 |
| 4,821,995 A | | 4/1989 | Merkel | |
| 4,881,716 A | | 11/1989 | Dingler | |
| D312,201 S | | 11/1990 | Gates | |
| 4,975,009 A | * | 12/1990 | Easton et al. | 249/45 |

(List continued on next page.)

*Primary Examiner*—Michael Safavi
(74) *Attorney, Agent, or Firm*—Wood, Herron & Evans, LLP

(57) ABSTRACT

A sliding pin is selectively mounted to the back of a poured concrete wall form panel for use in combination with a standard wedge for coupling adjacent panels of the concrete wall form together. The pin when attached to the panel conveniently slides relative to the panel to and between engaged, stowed and retracted positions. Furthermore, the pin is captured within a carrier and is rotatable for convenient access to the slot in the shank of the pin. The components of the system are durable to withstand impact blows by a hammer or other tool, do not require specialized hardware for their use and will not be fouled by splashed concrete or other debris.

29 Claims, 9 Drawing Sheets

U.S. PATENT DOCUMENTS 5,058,855 A 10/1991 Ward
5,078,360 A 1/1992 Spera
5,174,909 A 12/1992 Ward
5,251,868 A 10/1993 Trimmer et al.
5,265,836 A 11/1993 Dale
5,288,051 A 2/1994 Ward
5,744,076 A * 4/1998 Baxter ..... 249/45
5,759,429 A 6/1998 Trimmer et al.
5,802,795 A 9/1998 Myers et al.
5,827,442 A * 10/1998 Wicker et al. ..... 249/193
5,852,907 A * 12/1998 Tobin et al. ..... 249/191
5,968,403 A * 10/1999 Myers et al. ..... 249/44

* cited by examiner

ATTACHED PIN FOR POURED CONCRETE WALL FORM PANELS

This claims the benefit of U.S. Provisional Patent Application Serial No. 60/214,338, filed Jun. 27, 2000 and hereby incorporated by reference in its entirety.

BACKGROUND OF THE INVENTION

This invention relates generally to poured concrete wall forms and, more particularly, to connecting hardware for panels coupled together and used to construct the concrete wall form.

It is well known in the art to use prefabricated reusable panels to construct a wall form for a poured concrete wall. Typically, two spaced opposed parallel sets of forms are erected in order to pour concrete therebetween and form a wall. Each form is constructed of a number of adjacent interconnected panels. Tie rods are used to maintain the spacing between the opposed forms constructed of the panels.

Typically, each panel has a marginal frame projecting rearwardly from a back face of the panel to include a flange along the spaced side edges of the panel. The flanges are adapted to be positioned in an abutting relationship with the flange of an adjacent panel to construct the concrete wall form. Holes in the flanges of the adjacent panels can be aligned to receive there through the shank of a pin or a bolt. The pin or bolt may pass through the ends of the ties and commonly are held in position by wedges which are driven through a slot in the shank of the pin or bolt. As the wedges are driven into the slot, the abutting flanges of the adjacent panels are drawn together. The pins and wedges offer a simple mechanism for effectively coupling the panels together.

After the concrete has been poured and the wall has set, the pins and wedges are removed from the panels during the dismantling of the wall form by dislodging the wedges from the slots and sliding the pins from the holes to release the adjacent panels.

In the construction of a concrete wall form, a large quantity of hardware is necessary to connect the adjacent panels together. Typically, the workers performing the construction of the wall form carry a large bucket of the pins and wedges with them to join the adjacent panels together. During such operations, the loss of the attachment hardware is appreciable, especially during inclement weather as it is difficult for a worker wearing gloves to handle the pins and wedges. Furthermore, the wall forms are commonly constructed in excavated areas, such as ditches and trenches, for a poured concrete wall in a residential basement or below ground floor of a commercial building. The workers commonly move around on scaffolding when constructing the concrete wall forms. As such, the work space for constructing a wall form and for the workers to maneuver and manipulate the associated hardware is extremely tight and limited. Therefore, the installation of the pins and wedges is even more difficult and retrieval of any lost hardware is very problematic. As such, the cost of labor and materials has increased accordingly due to these problems.

One prior art solution aimed at some of these problems has been to permanently connect at least some of the hardware to the panels. Each panel has numerous sets of such devices. Problems frequently arise because one or more sets of the hardware permanently affixed to the panels breaks or requires repair thereby taking that particular panel out of service until it is repaired. Furthermore, the addition of the attachment hardware commonly adds significant weight to each panel thereby placing a greater burden on the workers for transporting, installing and manipulating the panels in constructing and disassembling the wall form.

Moreover, a particular contractor may have an inventory of panels which are not compatible with the panels having permanently affixed hardware thereby requiring the contractor to entirely discard the current supply of panels and associated hardware in favor of the panels having a specific attachment hardware design. While such systems may minimize the occurrence of lost pins and/or wedges, they include other drawbacks. Very often, specialized tooling is required for the installation, repair and/or use of known attached systems thereby minimizing the universal application and use of such systems.

When the concrete is poured between the spaced forms and assembled panels, the hydrostatic forces generated by the poured concrete tend to spread the opposed forms apart, but these outward or spreading forces are held in check by the form tie rods. In addition, the concrete expands as it sets creating greater spreading forces on the panels. The pin joining the adjacent panels together is subject to significant pulling forces by the tie rod and an opposed force by the frame or rail on the panel. These forces can make removing the pins from the panels and the tie rods very difficult often requiring a number of repeated blows from a sturdy sledge hammer or the like to dislodge the pin and/or wedge from the panels. The hammering can damage known attachment hardware and/or mushroom the point of the pin causing interference with its operation. The workers frequently damage or destroy the pins during disassembly of a form which significantly shortens the life of the attached hardware and associated panel.

Another problem common with attached hardware is that liquid from the poured concrete frequently splashes onto the rear sides of the forms and the associated hardware. When the concrete spills or splashes onto the attachment hardware, it naturally sticks to the attachment hardware as it sets up and makes disengaging the pin and wedge more difficult. The spilled concrete also fouls the associated hardware thereby minimizing its usefulness.

Therefore, there is a need for attachment hardware for concrete wall form panels that is durable, easy to engage between the adjacent form panels, easy to remove after the concrete has set, that is easily and conveniently installed and disassembled by the workers in the field and does not significantly increase the weight of the panel and is compatible with standard pin and wedge systems.

SUMMARY OF THE INVENTION

These and other objectives of the invention have been attained by a system for releasably coupling adjacent panels to construct a wall form for a poured concrete wall. The system includes a pin assembly which can be selectively attached to a mount on each of the walls near the holes in the marginal frame of the panels.

The system, according to a presently preferred embodiment of this invention, includes a pin which is movably mounted to one of the panels approximate each hole. The pin is movable between an engaged position in which the pin projects through each of the aligned holes in the adjacent panels, a stowed position in which the pin is withdrawn from each of the holes and a retracted position in which the pin is spaced from the frame to provide access for the standard pin and wedge attachment hardware when the pin of this system is not in use. The pin has a stem and a shank which are threadably coupled together as a two piece unit. The stem has an enlarged head on one end thereof and the shank has a slot which extends there through transverse to the longitudinal axis of the pin and a tapered region which is adapted to project through the holes in the frames of the panels. The tapered region on the pin is longer than known pin designs to assist in the removal of the pin from the tie rod during disassembly of the wall forms.

The pin assembly includes the two-piece pin and a carrier. The pin is housed within a throughbore of the carrier. The throughbore is in a casing of the carrier which is situated between a generally rectangular or oval lower slide and an upwardly projecting impact mast. The bore in the casing has an enlarged seat which is adapted to receive the head of the stem of the pin when the pin is housed in the casing with the shank projecting forwardly from the carrier. In one embodiment, the pin is free to rotate relative to the carrier in the bore of the casing. The upwardly projecting impact mast provides access for a worker to strike the carrier with a hammer to dislodge the pin from the tie rods and holes in the panels when disassembling the concrete wall forms.

The mount in one embodiment includes a base and a retainer. The slide of the carrier is captured between spaced channel side walls in a channel of the retainer for sliding the carrier and pin in the channel relative to the retainer. The bottom surface of the slide has a well and the confronting surface of the channel has a pair of detents. Each detent is biased to project from the bottom surface of the channel. The detents and the well cooperate to retain the carrier and the pin in the stowed and engaged positions, respectively, as the carrier and pin slide relative to the retainer. The retainer also has four extensions each of which project from a corner of the retainer and have an aperture there through.

The retainer is selectively mounted to the base which is welded or otherwise secured to the back face of each of the panels proximate the hole in the frame of the panel. The base has four notches which are adapted to retain a head of a fastener which projects through one of the apertures in the retainer to selectively bolt or secure the retainer to the base. The system also includes a standard wedge which is inserted into the slot of the pin when the pin is in the engaged position and projecting through the aligned holes in the adjacent panels.

In another embodiment specifically designed for use on steel ply wall forms, the mount includes the retainer and a pair of spaced preferably steel mount bars. The retainer is mounted by studs or other mechanical fasteners to the mount bars.

As a result of the system according to this invention, a simple and cost effective attachment mechanism to overcome the problems of previously known attachment hardware for poured concrete wall panel forms is provided. Specifically, the pin is selectively attached to the panel and is movable with the carrier between the stowed and engaged positions so that the likelihood of dropped and lost pins during the assembly and disassembly of the wall forms is eliminated. Furthermore, the system is robust and can readily withstand impact blows on the impact mast to dislodge the pin from the engaged position when the wall form panels are being disassembled. Moreover, impact directly on the tip of the pin will also result in dislodging the pin and sliding the pin and carrier from the engaged position toward the stowed position. Due to the configuration of the tapered region of the pin in one embodiment, removal of the pin from the tie rod and holes in the adjacent panels is significantly easier and more convenient. Further, if the pin is damaged, it can be easily replaced by unscrewing the shank from the stem and replacing the specific parts as required without costly service or extensive down time.

The pin and carrier can be moved to the retracted position thereby providing access to the aligned holes of the adjacent panels so a standard pin and wedge or other attachment hardware mechanism may be used without interference from the invention of this system. Moreover, the entire carrier, pin and retainer can be selectively attached or removed from the base or mount bars for use as desired by the poured wall contractor. Moreover, this system can be readily provided as original equipment with the base plate welded or secured to the panels and the carrier, retainer and pin selectively attached thereto. Likewise, the panels can be retrofit to include the base or mount bars and selectively secured components of the system for use as required. The operational interaction between the carrier and the retainer will not be fowled by splashed or spilled concrete because the components of the system which interact with one another are concealed or captured. Furthermore, the slide and carrier are preferably non-metallic, more preferably nylon, so that concrete which splashes onto the hardware does not adhere to it.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
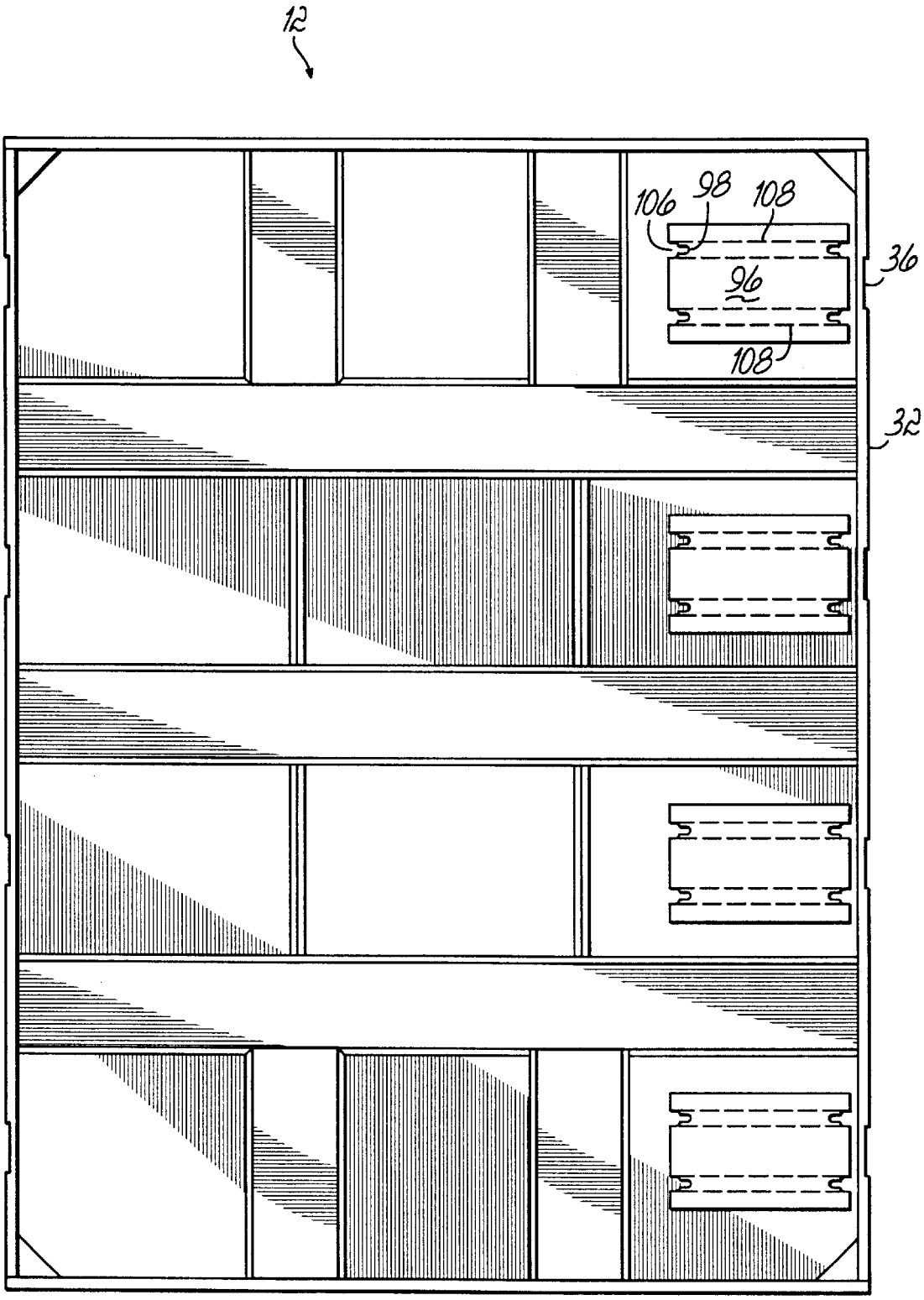
FIG. 1 is a plan view of a concrete wall form panel according to one embodiment of this invention with a number of base plates of the attached pin system mounted thereto.
Figure 2:
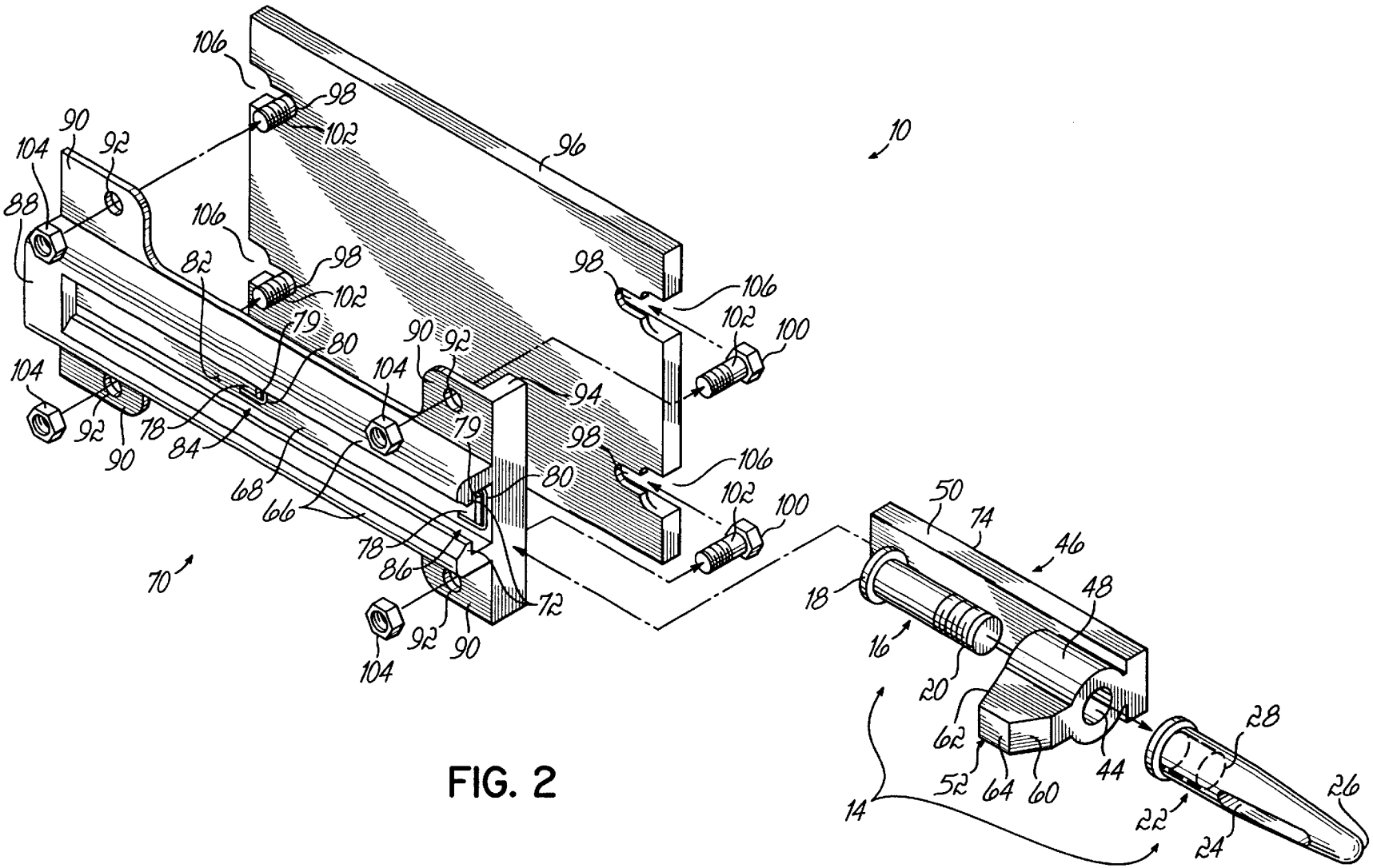
FIG. 2 is an exploded perspective view of components of the attached pin system for poured concrete wall panels according to one embodiment of this invention.

Referring to FIGS. 1 and 2, a presently preferred embodiment of an attachment system 10 for a poured concrete wall form panel 12 is shown. The attachment system 10 includes a pin assembly in which a pin 14 is comprised of two pieces including a generally cylindrical stem 16 having an enlarged disk-shaped head 18 on one end and threads 20 on an opposite end. A second portion of the pin 14 is a shank 22 which has a slot 24 extending transversely through the longitudinal axis of the shank and a tip 26 on one end. Opposite of the tip 26 is a threaded hole 28 in which to threadably receive the threads 20 on the stem 16 for coupling the stem 16 and the shank 22 of the pin 14 together.

Figure 3:
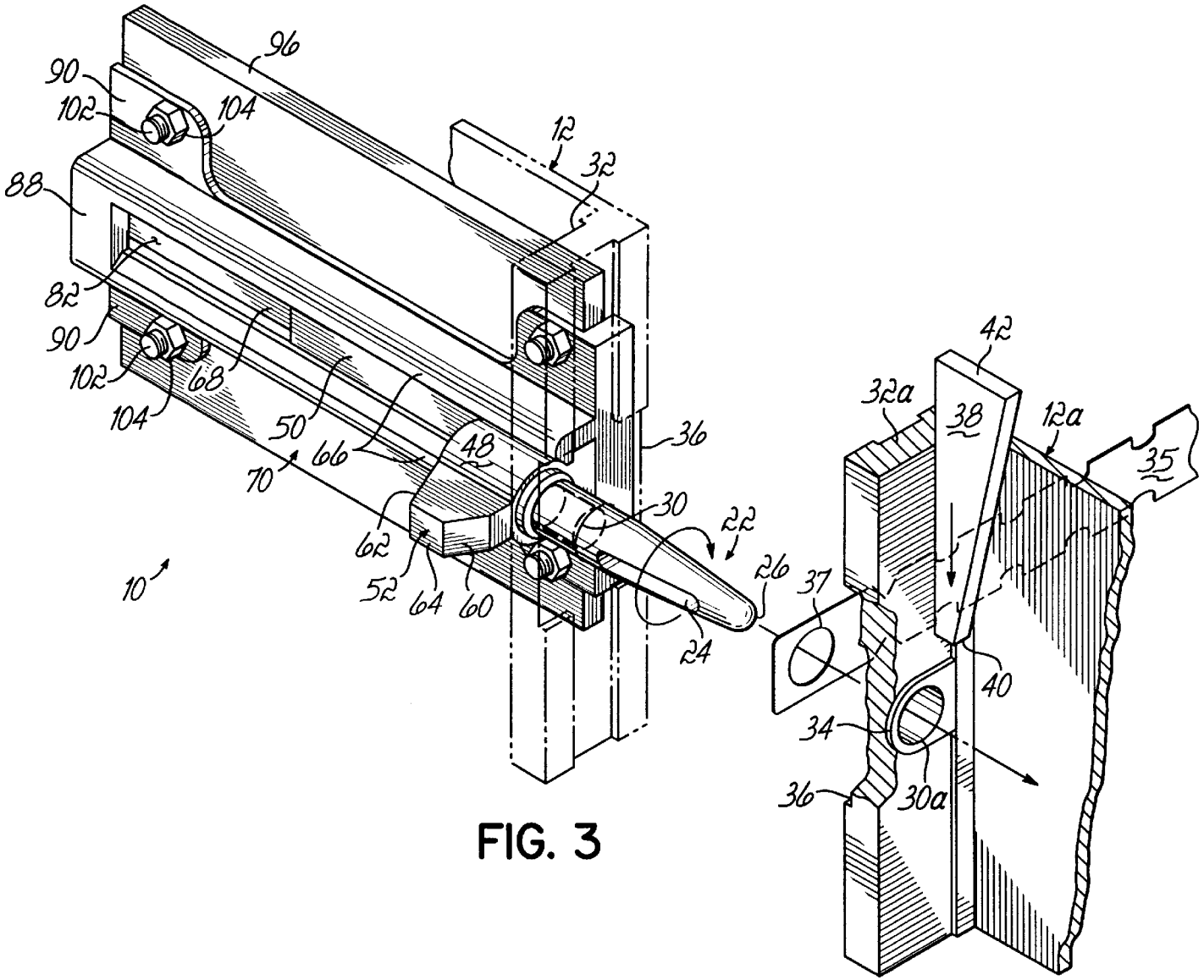
FIG. 3 is a perspective view of the system mounted to a panel which is being joined to an adjacent panel.

Referring to FIG. 3, the shank 22 of the pin 14 is sized for insertion through a hole 30 in a flange 32 of the panel 12 used for constructing a concrete wall form. The hole 30 in the flange 32 is aligned with a similarly configured hole 30*a* in a flange 32*a* of an adjacent panel 12*a*. The flange 32*a* may include a bushing 34 seated in the hole 30*a* and the diameter of the bushing 34 permits movement of the shank 22 of the pin 14 there through. One embodiment of a concrete wall form panel 12, 12*a* which is compatible with this invention is disclosed in U.S. patent application Ser. No. 09/232,414 filed Jan. 15, 1999, which is hereby incorporated by reference in its entirety.

As is well known in the art, a tie rod 35 having a hole 37 proximate an end thereof extends between the adjacent panels 12, 12*a* of the concrete wall form to maintain the spacing between the opposed panels (not shown) forming a cooperating wall form (not shown). The flanges 32, 32*a* may include a notch or cut-out 36 sized and configured to accommodate the tie rod 35 seated in the notch 36 so that the flanges 32, 32*a* of the adjacent panels 12, 12*a* can be juxtaposed in face-to-face abutting relationship.

A wedge 38 according to a presently preferred embodiment of this invention is well known in the art and includes a generally planar piece of steel or other appropriate metal which is dimensioned to fit within the slot 24 in the shank 22 of the pin 14. The wedge 38 has a tapered configuration so that a narrow end 40 of the wedge 38 passes into and through the slot 24 and a broad end 42 of the wedge 38 is wider than the slot 24 and is thereby prevented from passing through the slot 24. Wedges, as disclosed in U.S. Pat. No. 5,904,875, assigned to the assignee of this invention and hereby incorporated by reference, could be utilized with this invention.

Figure 4A:
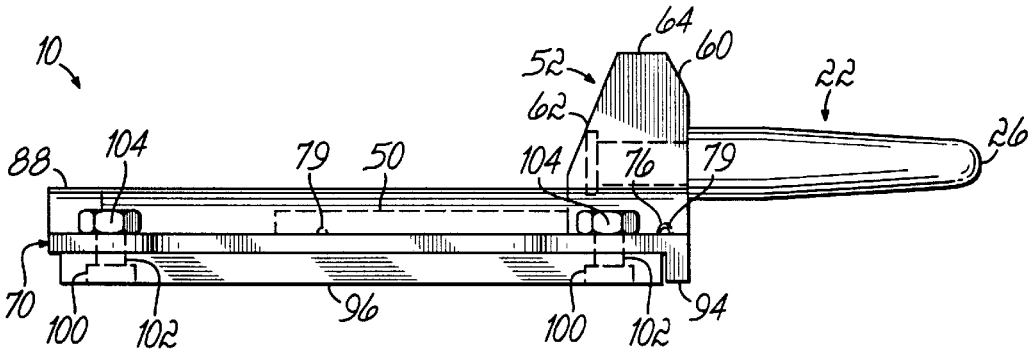
FIGS. 4A–4C are cross-sectional side views of the attachment hardware system according to a presently preferred embodiment of this invention in various configurations.

When the adjacent panels 12, 12*a* are positioned with the respective holes 30, 30*a* in the flanges 32, 32*a* being generally aligned, the pin 14 is projected through the hole 30 in the panel 12 to which the attachment hardware system 10 is mounted in an engaged position as shown in FIG. 4A. The hole 37 of the tie rod 35 may then be slipped onto the shank 22 of the pin 14 and then the shank 22 inserted into the hole 30*a* in the opposite flange 32*a* at which time the narrow end 40 of the wedge 38 is inserted into the slot 24 and hammered or forced into place thereby drawing the panels 12, 12*a* together and releasably coupling and binding them together forming a concrete wall form.

Figure 6A:
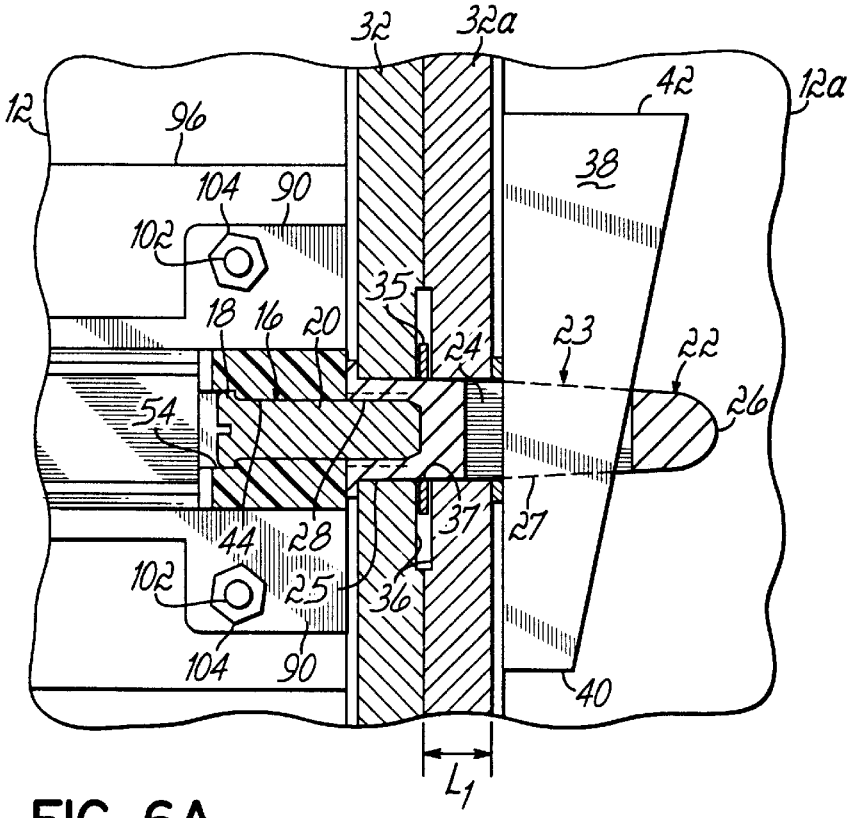
FIGS. 6A and 6B are sequential cross-sectional views of adjacent panels being disassembled and the disengagement of the tie rod from the pin assembly.
Figure 6B:
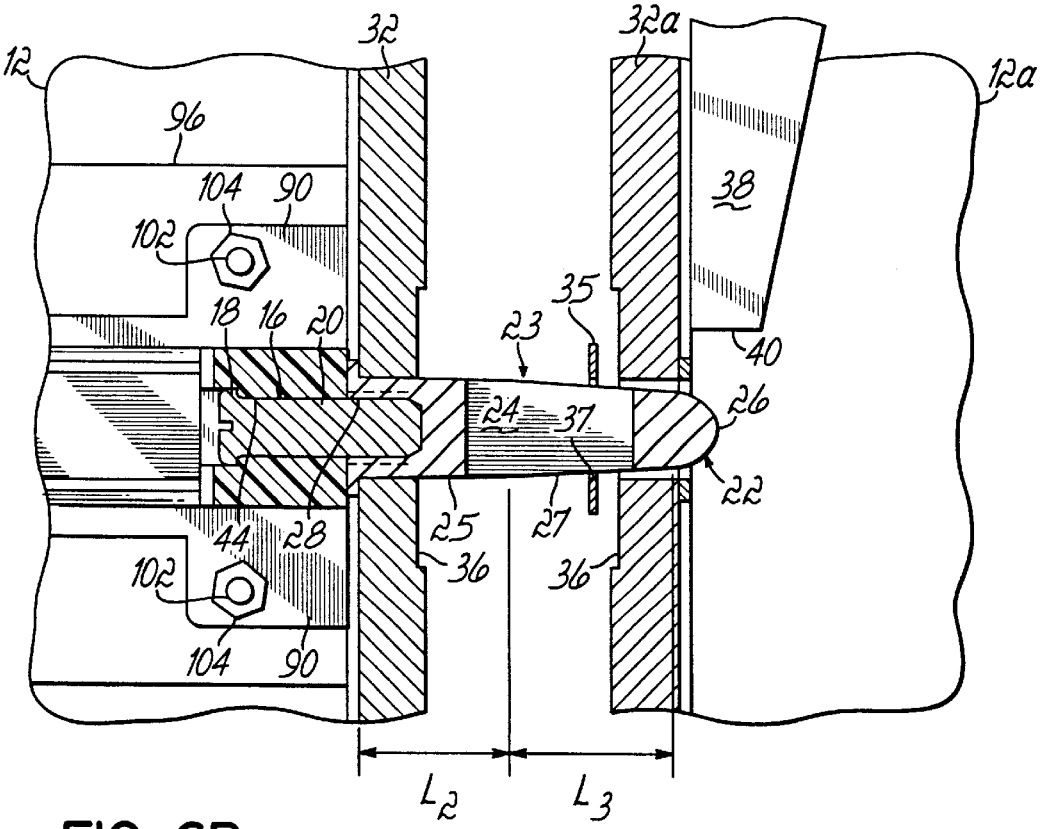

The shank 22 of the pin 14 preferably includes an extended length tapered region 23 (see FIGS. 6A and 6B). In one embodiment, the shank 22 is about 2.446 inches long and the tapered region 23 includes a first portion 25 proximate the head 18 and about 0.985 inches long ($L_2$) and forming an angle of about 91.056° with respect to the plane of the head 18. The tapered region 23 includes a second portion 27 adjacent the first portion 25 extending about 1.064 inches in length ($L_3$) and forming an angle of about 93.242° with respect to the plane of the head 18. The advantages of the tapered region 23 are detailed herein below.

The pin 14 is housed in a throughbore 44 of a carrier 46, as shown particularly in FIG. 2. The throughbore 44 is in a casing 48 of the carrier 46 which is situated between a lower slide 50 and an upwardly projecting impact mast 52. Although the slide 50 is shown in a generally rectangular shape, it may preferably have an oval cross-sectional configuration. Preferably, the impact mast 52, casing 48 and slide 50 are cast or integrally formed together to provide a more robust and sturdy carrier 46.

Figure 4B:
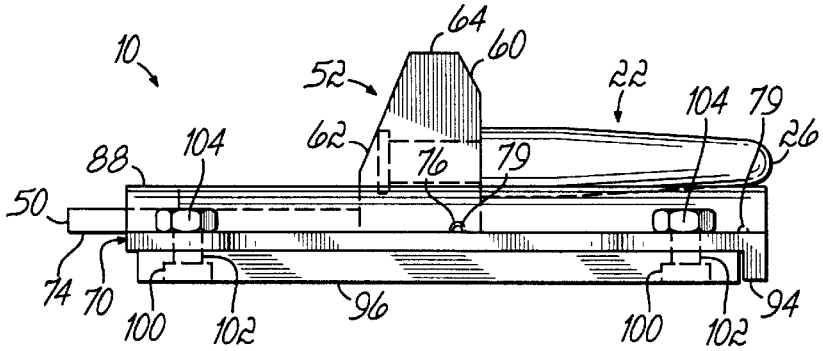
Figure 4C:
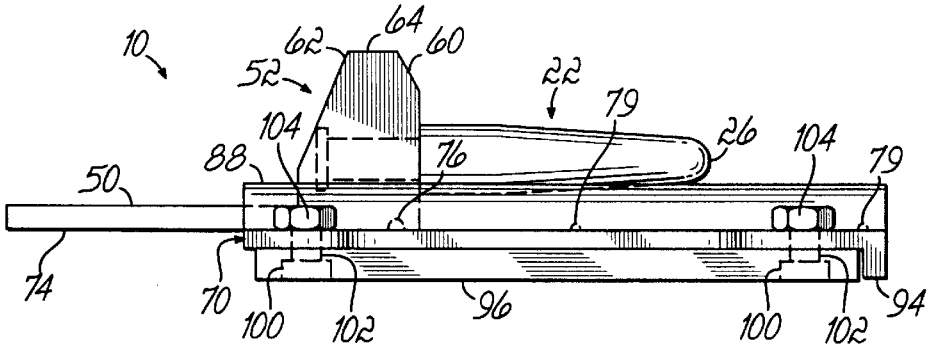
Figure 5:
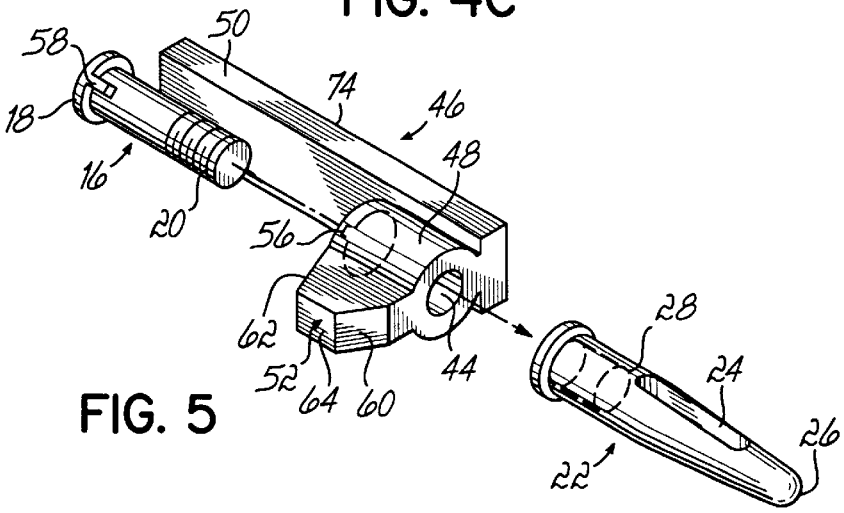
FIG. 5 is an exploded perspective view of an alternative embodiment of the pin and retainer of this invention.

The bore 44 in the casing 48 has an enlarged seat 54 in which the head 18 of the stem 16 of the pin 14 is received. The stem 16 is inserted into the throughbore 44 and ultimately threaded into the hole 28 in the shank 22 of the 14 pin to thereby assemble the two-piece pin 14 with the carrier 46. Preferably, the head 18 of the pin 14 is concealed within the casing 48 to prevent concrete or other debris from fowling interaction between the pin 14 and the carrier 46. In one embodiment as shown in FIGS. 1–4C, the pin 14 is free to rotate relative to the carrier 46 within the bore 44 for convenient alignment of the slot 24 in the shank 22 of the pin 14 and access for insertion and removal of the wedge 38. Alternatively, as shown in FIG. 5, the seat 54 in the throughbore 44 of the carrier 46 may include a notch 56 into which a lug 58 on the stem 16 is inserted to orient the pin 14 relative to the carrier 46 and thereby prevent rotation.

The impact mast 52 of the carrier 46 includes three faces; namely, forward and rear sloped faces 60, 62 which are on opposite sides of a top face 64. The forward and rear sloped faces 60, 62 provide impact surfaces for a hammer or other tool utilized by a worker to dislodge the pin 14 from the adjacent panel 12*a*. The sloped faces 60, 62 also offer a convenient location for manipulating the carrier 46 and pin 14 to and between the engaged position as shown in FIG. 4A, a stowed position as shown in FIG. 4B and a retracted position as shown in FIG. 4C. The configuration of the impact mast 52 and sloped faces 60, 62, 64 provides convenient access to a worker for striking the impact mast 52 with clearance relative to the flange 32 of the panel 12 when the pin 14 is in the engaged position. It should be readily understood that an alternate design or configuration for the impact mast 52 may be provided within the scope of this invention.

As shown particularly in FIG. 2, the slide 50 of the carrier is inserted between a pair of spaced channel sidewalls 66 forming a channel 68 in a retainer 70. Each channel sidewall 66 has an inwardly turned lip 72 which captures the slide 50 for movement in the channel 68 to and between the engaged, stowed and retracted positions of the carrier 46. A bottom surface 74 of the slide 50 has a generally oval-shaped well 76 formed therein.

As shown particularly in FIGS. 2 and 4A–4C, a bottom wall 82 of the channel 68 has a stowed detent 84 and an engaged detent 86 formed therein. Each detent 84, 86 includes a tab 78 cantilevered from the bottom wall 82 with a U-shaped slot 80 in the bottom wall 82 surrounding three sides of the tab 78. A boss 79 is formed on the distal end of each tab 78 and is sized and configured to be seated within the well 76 in the bottom surface 74 of the slide 50. The detents 84, 86 cooperate with the well 76 to retain the carrier 46 and the pin 14 in the stowed and engaged positions, respectively, as the carrier 46 and pin 14 slide relative to the retainer 70. Each boss 79 is biased upwardly to engage the well 76 when positioned appropriately. The detents 84, 86 can be manually disengaged from the well 76 by moving the carrier 46 and pin 14 in the retainer 70. Although not shown in FIG. 4C, a detent may also be provided in the channel 68 to retain the pin 14 and carrier 46 in the retracted position.

It should be readily understood that alternate designs or configurations for the detents 84, 86 could be provided within the scope of this invention.

A stop 88 is provided at a back edge of the channel to join the channel sidewalls 66 together and prevent the carrier 46 from sliding rearwardly out of the retainer 70. The retainer 70 also includes four extensions 90 each of which project from a corner of the retainer 70 and have an aperture 92 there through. A downwardly directed lip 94 is also provided along the front edge of the retainer 70.

Preferably, the retainer 70 and carrier 46 are molded or otherwise formed from Zytel® (ST801BK010) a nylon resin commercially available from Dupont (www.dupont.com). The pin 14 is preferably 4140 fully hardened alloy steel which, in combination with the preferred nylon resin of the carrier 46 and retainer 70, provide a robust and durable system 10 capable of withstanding the frequent and high impact blows commonly required during installation and disassembly of the wall forms. Moreover, concrete splashed onto the retainer 70 and carrier 46 will not adhere to these components avoiding the need to frequently scrape or remove hardened concrete which often results in damage to the components.

The retainer 70 is selectively mounted or secured to a base 96 which is welded or otherwise secured to the back face of the panel 12 near one of the holes 30 as shown in FIG. 1. The retainer 70 and base 96 provide a mount for the pin assembly. The base 96 has four notches 98 which are adapted to retain a head 100 of a fastener 102 such as a bolt or the like. The fastener 102 projects through one of the apertures 92 in the retainer 40 and is secured by a nut 104. The head 100 of each fastener 102 is inserted into the open mouth 106 of the respective notch 98 in a direction generally parallel to the plane of the base 96 as shown in FIG. 2. The base 96 includes two generally parallel channels 108 on the bottom surface thereof. The two aligned notches 98 proximate the top of the base as shown in FIG. 2 are joined together by one of the channels 108 and the two lower notches 98 are likewise joined by the other channel 108. The heads 100 of the fasteners 102 are recessed in the channels 108 relative to the bottom of the base 96.

In this way, the bases 96 can be provided on the panel 12 with the retainer 70, carrier 46 and pin 16 being selectively mounted to each of the bases 96 on the panel 12 as required. Alternatively, the panels 12 may be retrofit to have the bases 96 added thereto by welding or similar mounting techniques and the retainer 70, carrier 46 and pin 14 can then be selectively mounted to the base 96 as required.

Referring to FIGS. 6A and 6B, the advantageous feature of the extended tapered region 23 of the pin assembly according to this invention will now be described. The marginal flange 32, 32*a* of each of the adjacent panels 12, 12*a* typically has a length represented by $L_1$ as shown in FIG. 6A. The extended tapered region 23 of the pin 14 has the first portion 25 adjacent the head 18 having a length represented by $L_2$ and the second portion 27 having a length represented by $L_3$. When the panels 12,12*a* are assembled together with the wedge 38 inserted in the slot 24 of the pin 14 as shown in FIG. 6A, the tie rod 35 is positioned on the pin 14 in the first portion 25. After the concrete has been poured and cured, significant stresses and forces are experienced by the pin 14 and tie rod 35. Disassembly of the panels 12, 12*a* and removal of the pin 14 from the flanges 32, 32*a* and the tie rod 35 from the pin 14 requires the user to overcome these forces and dislodge the pin 14 from the marginal flange 32, 32*a* and the tie rod 35 from the pin 14. Currently, during disassembly of the forms as the adjacent panels 12, 12*a* are separated from one another, a tapered portion 29 of a standard pin 31 (see FIG. 7) is concealed within the flange 32*a* of the adjacent panel 12*a* and the tip 33 of the pin 31 is likewise concealed within the hole 30*a* of the adjacent flange 32*a*. Therefore, the tie rod 35 remains seated on the generally cylindrical shaft 39 of the standard pin 31 and it is difficult for an operator to dislodge the pin 31 from the tie rod 35 because of the stresses. Further, the user does not have access to the tip 33 of the pin 31 to strike it with a hammer and dislodge it from the tie rod 35 because the tip 33 of the pin 31 is concealed within the flange 32*a*.

The extended tapered region 23 of the pin 14 of this invention advantageously promotes the disassembly of the pin 14 from the tie rod 35. Specifically, as shown in FIG. 6B, when the marginal flanges 32, 32*a* of the adjacent panels 12, 12*a* are separated, the tie rod 35 is positioned in the extended tapered region 23 of the pin 14 and most likely on the second portion 27 thereof. In this configuration, separation of the tie rod 35 from the pin 14 is promoted because the tie rod 35 will naturally slide or eject the pin 14 because of the stresses promoting the translation of the tie rod 35 on the tapered region 23 of the pin 14 toward the tip 26. Moreover, the tip 26 of the pin 14 is exposed or accessible for a tool or hammer to impact the pin 14 and further promote the disengagement of the tie rod 35 from the pin assembly.

Figure 7:
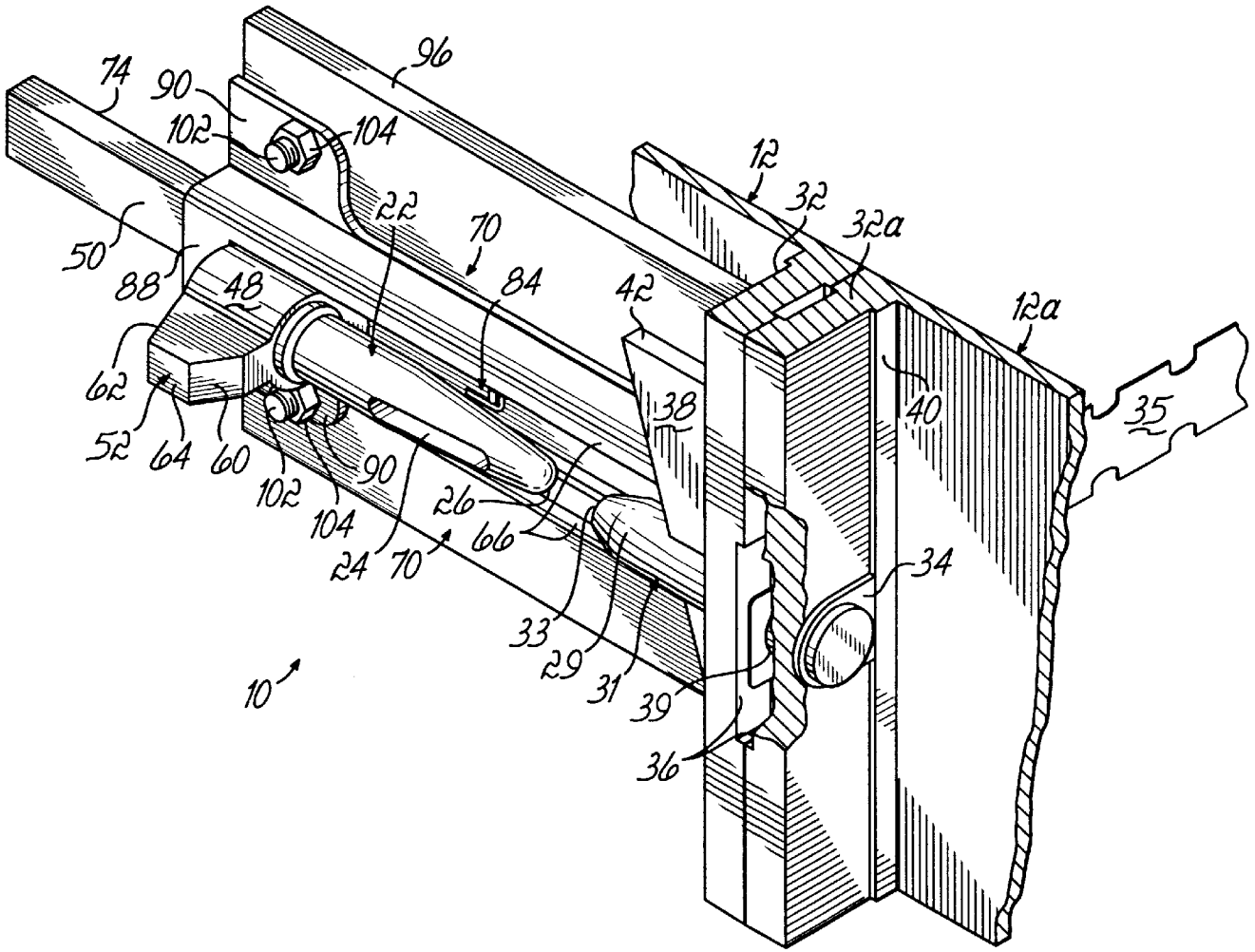
FIG. 7 is a perspective view of a pair of adjacent panels coupled together by a standard pin and wedge system and the attached pin system of this invention in a retracted position.

Referring to FIG. 7, one advantage of the system 10 according to this invention is the capability of moving the pin assembly from the engaged or stowed positions (FIGS. 4A and 4B, respectively) to the retracted position (FIGS. 4C and 7). When in the retracted position, ample clearance is available for access to the holes 30, 30*a* for use of the standard pin 31 and wedge 38 to couple the panels 12, 12*a* together as an alternate latching mechanism. Specifically, the standard pin 31 is inserted into the hole 30*a* and projects through the hole 30 in an opposite direction to the pin 14. As such, the pin 14 in the retracted position remains conveniently mounted to the panel 12 for subsequent use while the alternate latching mechanism is utilized as desired. While the retracted position as shown in FIGS. 4C and 7 is linearly aligned with respect to the hole 30 and the stowed and engaged positions, it could be oriented off-axis, non-linearly or otherwise within the scope of this invention.

Referring to FIGS. 8A through 10, an alternative presently preferred embodiment of an attachment system 110 for a poured concrete wall form panel is shown. Specifically, this embodiment is designed for use on steel ply wall forms of the type disclosed in U.S. Pat. Nos. 3,204,918; 3,362,676; and 5,265,836, each of which are incorporated by reference herein. As is well known in the art, so called steel ply wall form panels typically include a perimeter steel frame with flanges and a plywood panel inserted therein.

The attachment system 110 includes a pin assembly in which a pin 114 is comprised of two pieces including a generally cylindrical stem 116 having an enlarged disk-shaped head 118 on one end and threads 120 on an opposite end. A second portion of the pin 114 includes a generally planar shank 122 which has a slot 124 extending transversely through the longitudinal axis of the shank 122 and a tip 126 on one end. A hole 127 is included in the shank 126 between the slot 124 and the tip 126 as is well know for inclusion on pins for use with steel ply wall forms. Opposite of the tip 126 is a barrel 129 with a threaded axial hole 128 in which to threadably receive the threads 120 on the stem 116 for coupling the stem 116 and the shank 122 of the pin 114 together. A generally circular disk 130 is included between the shank 122 and the barrel 129. A pair of lobes 132 are diametrically spaced on the barrel 129 and project from one face of the disk 130.

Figure 9:
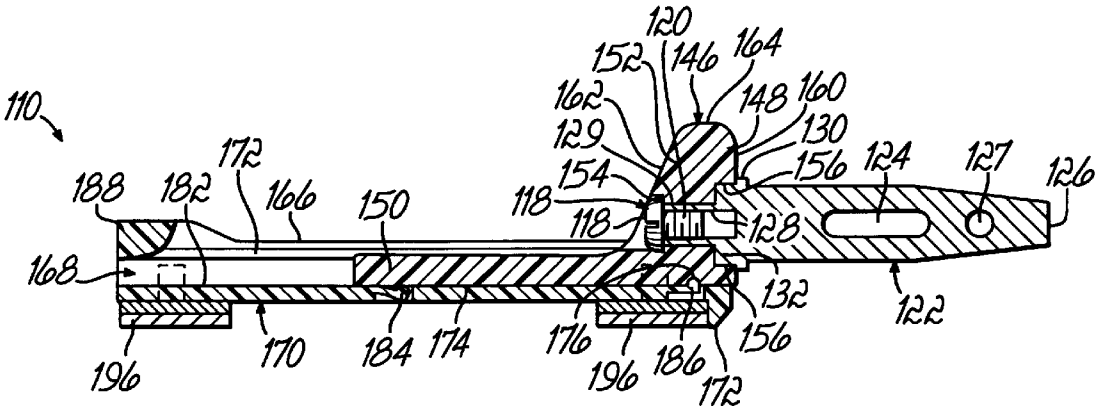
FIG. 9 is a cross-sectional view taken along line 9—9 of the embodiment of FIG. 8A.
Figure 10:
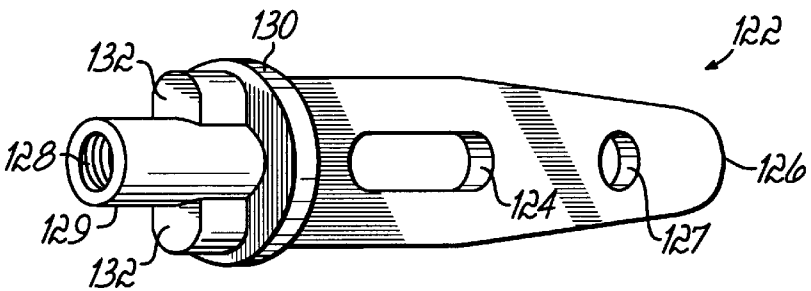
FIG. 10 is a perspective view of a shank of a pin according to the embodiment of FIGS. 8A–9.

The pin 114 is housed in a throughbore 144 of a carrier 146, as shown particularly in FIG. 9. The throughbore 144 is in a casing 148 of the carrier 146 which is situated between a lower slide 150 and an upwardly projecting impact mast 152. The slide 150 is preferably oval in a cross-sectional configuration. Preferably, the impact mast 152, casing 148 and slide 150 are cast or integrally formed together to provide a more robust and sturdy carrier 146.

The bore 144 in the casing 148 has an enlarged seat 154 in which the head 118 of the stem 116 of the pin 114 is received. The stem 116 is inserted into the throughbore 144 and ultimately threaded into the hole 128 in the shank 122 of the 114 pin to thereby assemble the two-piece pin 114 with the carrier 146. Preferably, the head 118 of the pin 114 is concealed within the casing 148 to prevent concrete or other debris from fowling interaction between the pin 114 and the carrier 146. In the embodiment as shown in FIGS. 8A–10, the pin 114 is inhibited from rotation relative to the carrier 146 within the bore 144. The seat 154 in the throughbore 144 of the carrier 146 includes a pair of notches 156 into which the lobes 132 projecting from the disk 130 are inserted to orient the pin 114 relative to the carrier 146 and thereby prevent rotation.

Figure 8B:
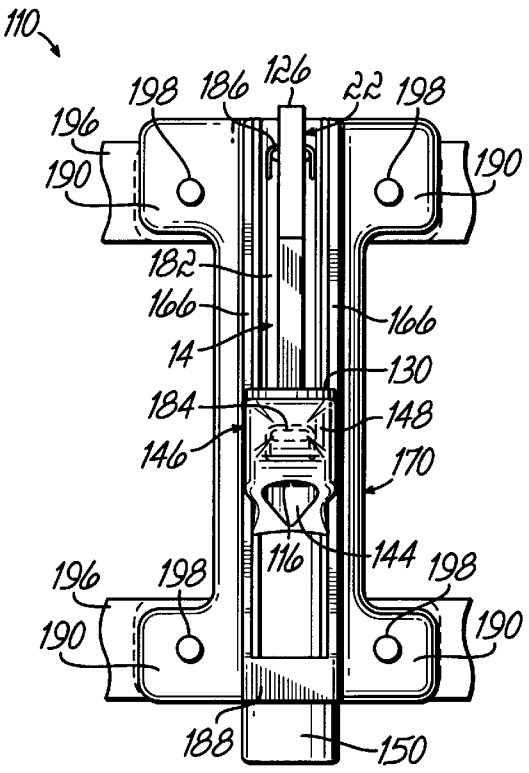
FIGS. 8A–8C are top plan views of an alternative embodiment of this invention in engaged, stowed and retracted positions, respectively.

The impact mast 152 of the carrier 146 is similar to the embodiment shown in FIGS. 2–5 in that it includes three faces; namely, forward and rear sloped faces 160,162 which are on opposite sides of a top face 164. Additionally, the carrier 146 and pin 114 are translated to and between the engaged position as shown in FIG. 8A, a stowed position as shown in FIG. 8B and a retracted position as shown in FIG. 8C.

Figure 8A:
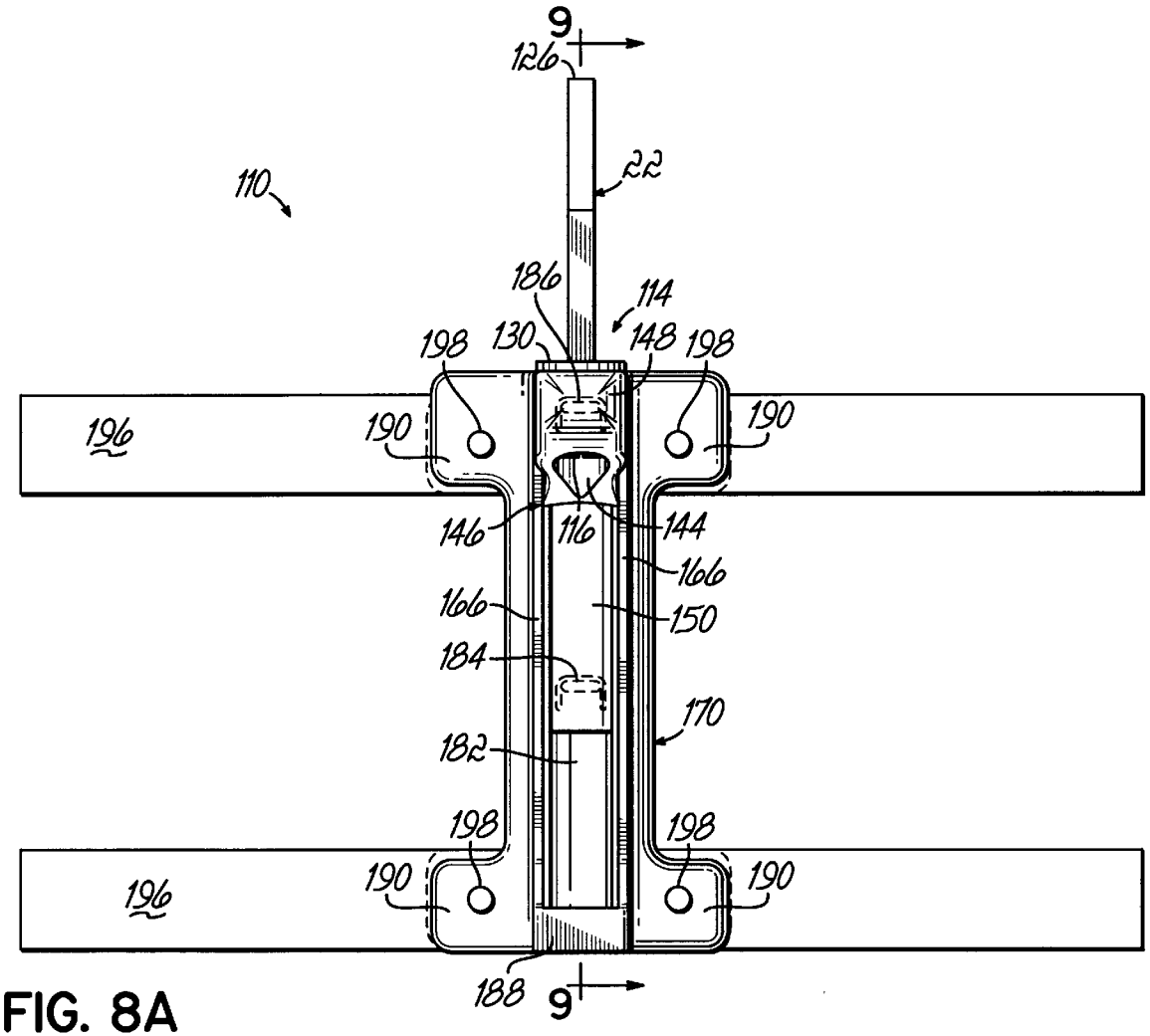
Figure 8C:
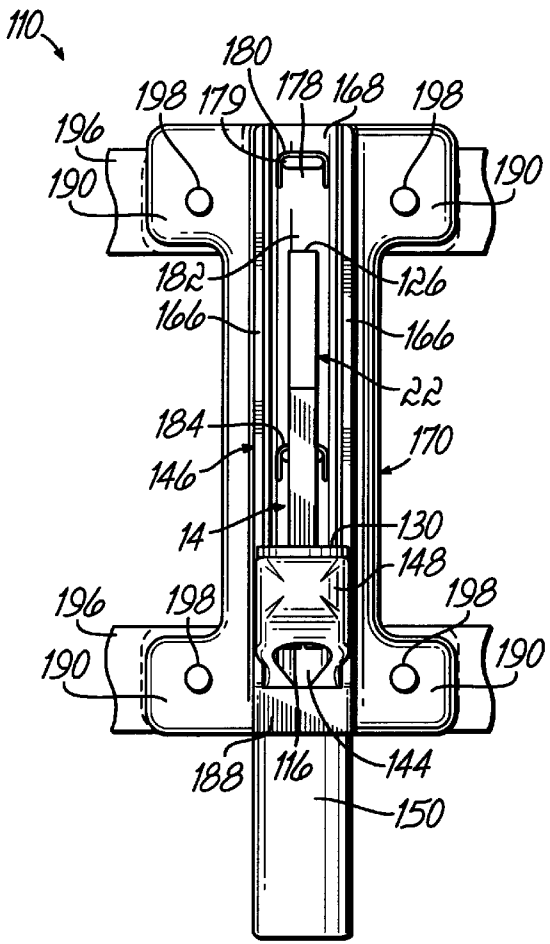

As shown particularly in FIGS. 8A through 9, the slide 150 of the carrier 146 is inserted between a pair of spaced channel sidewalls 166 forming a channel 168 in a retainer 170. Each channel sidewall 166 has an inwardly turned lip 172 which captures the slide 150 for movement in the channel 168 to and between the engaged, stowed and retracted positions of the carrier 146. A bottom surface 174 of the slide 150 has a generally oval-shaped well 176 formed therein. A bottom wall 182 of the channel 168 has a stowed detent 184 and an engaged detent 186 formed therein. Each detent 184,186 includes a tab 178 cantilevered from the bottom wall 182 with a U-shaped slot 180 in the bottom wall 182 surrounding three sides of the tab 178. A boss 179 is formed on the distal end of each tab 178 and is sized and configured to be seated within the well 176 in the bottom surface 174 of the slide 150. The detents 184, 186 cooperate with the well 176 to retain the carrier 146 and the pin 114 in the stowed and engaged positions. It should be readily understood that alternate designs or configurations for the detents 84, 86 could be provided within the scope of this invention. Preferably, the retainer 170 and carrier 146 are molded or otherwise formed from Zytel® (ST801 BK010) a nylon resin commercially available from Dupont (www.dupont.com).

A stop 188 is provided at a back edge of the channel 168 to join the channel sidewalls 166 together and prevent the carrier 146 from sliding rearwardly out of the retainer 170. The retainer 170 also includes four extensions 190 each of which project from a corner of the retainer 170 and have an aperture 192 there through. A downwardly directed lip (not shown) is also provided along the front edge of the retainer 170.

The retainer 170 is selectively mounted or secured to a base which includes a pair of spaced generally parallel, preferably steel mount bars 196 which are welded or otherwise secured to the frame and/or back face of the steel ply wall form panel near one of the holes in the flange. The retainer 170 and mount bars 196 provide a mount for the pin assembly. Mounting studs 198 or other appropriate mechanical fasteners are inserted into the apertures 192 to secure the retainer 170 to the mount bars 196 as shown in FIG. 8A. The mount bars 196 are preferably permanently mounted to the steel ply wall form panel and the retainer 170 may be removably or permanently mounted to the mount bars 196.

Figure 12:
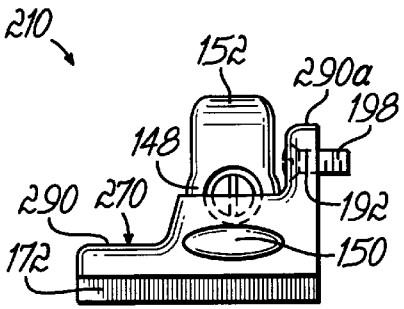
FIG. 12 is a back elevational view of the embodiment of FIG. 11.
Figure 11:
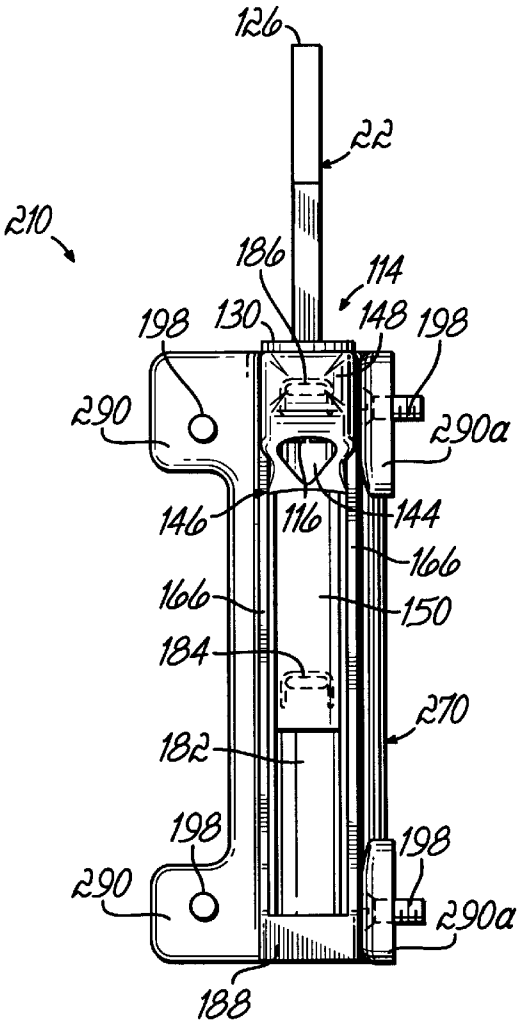
FIG. 11 is a top plan view of a further alternative embodiment of this invention.

A further alternative embodiment of this invention is shown in FIGS. 11–12. This embodiment is similar to that of FIGS. 8A–10 with the exception that the retainer 270 is modified so that two of the extensions 290*a* on one side of the retainer 270 are oriented perpendicularly relative to the remaining two extensions 290 of the retainer 270. This configuration of the retainer 270 is particularly useful for installation adjacent to a flange (not shown in FIGS. 11–12) of the steel ply wall form panel. The mounting studs, screws or other fastener 198 in the perpendicularly oriented extensions 290*a* are fastened to the flange while the fasteners 198 in the other extensions 290 are fastened to the mount bars 196 or back face of the panel.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A system for releasably coupling adjacent panels to construct a wall form for a poured concrete wall, each of the panels having a marginal frame with holes in the frame so that the holes of the adjacent panels are aligned with one another in the wall form, the system comprising:

a pin movably mounted to one of the panels proximate each hole;

wherein the pin is movable between an engaged position in which the pin projects through each of the aligned holes of the adjacent panels, a stowed position and a retracted position;

wherein the pin further comprises a stem and a shank which are threadably coupled together;

an enlarged head on one end of the stem;

a slot extending through the shank transverse to a longitudinal axis of the pin;

a tapered region on the pin proximate a distal end of the pin which is adapted to project through the holes;

wherein the tapered region has a length greater than a thickness of the marginal frame of the adjacent panel;

a carrier having a slide, an impact mast and a casing situated therebetween;

a bore with an enlarged seat in the casing;

wherein the pin is housed in the casing with the head being positioned in the enlarged seat, the pin being free to rotate relative to the carrier in the bore;

a well on a bottom surface of the slide;

a retainer having a channel formed between spaced channel sidewalls;

wherein the slide of the carrier is captured by the channel sidewalls for sliding movement in the channel relative to the retainer;

a stowed detent and an engaged detent on a bottom wall of the channel, the stowed and engaged detents each being adapted to engage the well on the bottom surface of the slide to releasably retain the carrier and the pin in the stowed and engaged positions, respectively;

a plurality of extensions each of which projects from the retainer and has an aperture there through;

a base adapted to be mounted to one of the panels proximate the hole;

a plurality of notches in the base;

a plurality of fasteners each of which have a head and are adapted to be retained in one of the notches of the base and project through one of the apertures in the retainer to selectively secure the retainer to the base; and a wedge adapted to be inserted into the slot of the pin when in the engaged position and projecting through the aligned holes in the adjacent panels.

2. A system for releasably coupling a pair of adjacent panels to construct a wall form for a poured concrete wall, each of the panels having a marginal frame with holes in the frame so that the holes of the adjacent panels are aligned with one another in the wall form, the system comprising:

a mount attached to one of the panels proximate a first one of the holes in the frame;

a primary latching mechanism comprising a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an alternate latching mechanism for coupling the adjacent panels together utilizing the first and aligned holes;

wherein the pin assembly is also movable to a retracted position which provides access to the first and aligned holes for use of the alternate latching mechanism.

3. The system of claim 2 further comprising a pin assembly through slot proximate a distal end of the pin assembly;

wherein the alternate latching mechanism further comprises:

a freestanding pin adapted to be inserted into the first and aligned holes;

a freestanding pin through slot proximate a distal end of the freestanding pin; and a freestanding wedge adapted to be inserted into the freestanding pin through slot when the freestanding pin is inserted through the first and aligned holes to couple the adjacent panels together and adapted to be inserted into the pin assembly through slot when the pin assembly is inserted through the first and aligned holes to couple the adjacent panels together.

4. The system of claim 2 wherein the mount further comprises:

a base fixed to the panel; and a carrier removably mounted to the base.

5. The system of claim 4 wherein the pin assembly further comprises:

a slide coupled to the mount for movement relative to the first hole; and a pin on the slide.

6. The system of claim 5 wherein the engaged, stowed and retracted positions are linearly arranged with the retracted position being spaced a greater distance from the marginal frame than the stowed position which is spaced a greater distance from the marginal frame than the engaged position.

7. The system of claim 2 further comprising:

an impact means on the pin assembly for being struck with a tool to dislodge the pin assembly from the engaged position.

8. The system of claim 2 further comprising:

an impact mast on the pin assembly adapted to be struck with a tool to dislodge the pin assembly from the engaged position;

wherein the impact mast projects upwardly from the pin assembly beyond the mount to provide convenient access for being struck.

9. The system of claim 2 further comprising:

a through slot in the pin assembly proximate a distal end thereof; and a wedge adapted to be inserted into the through slot in the pin assembly when the pin assembly is in the engaged position to couple the adjacent panels together.

10. The system of claim 2 further comprising:

detent means for releasably retaining the pin assembly in the engaged and stowed positions.

11. The system of claim 2 further comprising:

an engaged detent on one of the pin assembly and the mount to releasably retain the pin assembly in the engaged position; and a stowed detent on one of the pin assembly and the mount to releasably retain the pin assembly in the stowed position.

12. The system of claim 11 wherein the stowed and engaged detents each further comprise:

a biased tab on the mount;

a boss proximate a distal end of the tab; and a well on the pin assembly adapted to mate with the boss to releasably retain the pin assembly in the stowed and engaged positions, respectively.

13. A system for releasably coupling a pair of adjacent panels to construct a wall form for a poured concrete wall, each of the panels having a marginal frame with holes in the frame so that the holes of the adjacent panels are aligned with one another in the wall form, the system comprising:

a mount attached to one of the panels proximate a first one of the holes in the frame;

a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an impact mast on the pin assembly adapted to be struck with a tool to dislodge the pin assembly from the engaged position;

wherein the impact mast projects upwardly from the pin assembly to a level above the mount to provide convenient access for being struck.

14. A combination comprising:

a pair of panels for use in constructing a poured concrete structure, each of the panels having a marginal frame with holes in the frame so that the holes of the adjacent panels are adapted to be aligned with one another;

a mount attached to one of the panels proximate a first one of the holes in the frame;

a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an impact mast on the pin assembly adapted to be struck with a tool to dislodge the pin assembly from the engaged position;

wherein the impact mast projects upwardly from the pin assembly to a level above the mount to provide convenient access for being struck.

15. A system for releasably coupling a pair of adjacent panels to construct a wall form for a poured concrete wall, each of the panels having a marginal frame with holes in the frame so that the holes of the adjacent panels are aligned with one another in the wall form, the system comprising:

a mount attached to one of the panels proximate a first one of the holes in the frame;

a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an alternate latching mechanism for coupling the adjacent panels together utilizing the first and aligned holes;

wherein the pin assembly is also movable to a retracted position which provides access to the first and aligned holes for use of the alternate latching mechanism;

wherein a tie rod is positioned between the marginal frames of the adjacent panels and engages the pin assembly when the pin assembly is in the engaged position, the pin assembly further comprising:

a tapered region proximate to a distal end thereof;

wherein the tapered region extends a length of the pin assembly greater than a thickness of the marginal frame of the adjacent panel;

whereby the tie rod is engaged with the tapered region while the pin assembly is moving from the engaged position to the stowed position to promote release of the tie rod from the pin assembly.

16. The system of claim 15 whereby the distal end of the pin assembly is not concealed within the aligned hole of the adjacent panel when the tie rod is engaged with the tapered region to provide access to the distal end for a tool striking the distal end and moving the pin assembly toward the stowed position.

17. A combination comprising:

a pair of panels for use in constructing a poured concrete structure, each of the panels having a marginal frame with holes in the frame so that the holes of the adjacent panels are adapted to be aligned with one another;

a mount attached to one of the panels proximate a first one of the holes in the frame;

a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an alternate latching mechanism for coupling the adjacent panels together utilizing the first and aligned holes;

wherein the pin assembly is also movable to a retracted position which provides access to the first and aligned holes for use of the alternate latching mechanism;

wherein a tie rod is positioned between the marginal frames of the adjacent panels and engages the pin assembly when the pin assembly is in the engaged position, the pin assembly further comprising:

a tapered region proximate to a distal end thereof;

wherein the tapered region extends a length of the pin assembly greater than a thickness of the marginal frame of the adjacent panel;

whereby the tie rod is engaged with the tapered region while the pin assembly is moving from the engaged position to the stowed position to promote release of the tie rod from the pin assembly.

18. The combination of claim 17 whereby the distal end of the pin assembly is not concealed within the aligned hole of the adjacent panel when the tie rod is engaged with the tapered region to provide access to the distal end for a tool striking the distal end and moving the pin assembly toward the stowed position.

19. A combination comprising:

a pair of panels for use in constructing a poured concrete structure, each of the panels having a marginal frame with holes in the frame so that the holes of the adjacent panels are adapted to be aligned with one another;

a mount attached to one of the panels proximate a first one of the holes in the frame;

a primary latching mechanism comprising a pin assembly coupled to the mount for movement relative to the first hole;

wherein the pin assembly is movable relative to the mount to and between an engaged position in which a portion of the pin assembly projects through the first hole in the frame and into an aligned hole in the adjacent panel and a stowed position in which the pin assembly is withdrawn from the aligned hole in the adjacent panel for disassembly of the adjacent panels from one another; and an alternate latching mechanism for coupling the adjacent panels together utilizing the first and aligned holes;

wherein the pin assembly is also movable to a retracted position which provides access to the first and aligned holes for use of the alternate latching mechanism.

20. The combination of claim 19 further comprising:

a through slot in the pin assembly proximate a distal end thereof; and a wedge adapted to be inserted into the through slot in the pin assembly when the pin assembly is in the engaged position to couple the adjacent panels together.

21. The combination of claim 19 further comprising:

detent means far releasably retaining the pin assembly in the engaged and stowed positions.

22. The combination of claim 19 further comprising:

an engaged detent on one of the pin assembly and the mount to releasably retain the pin assembly in the engaged position; and a stowed detent on one of the pin assembly and the mount to releasably retain the pin assembly in the stowed position.

23. The combination of claim 22 wherein the stowed and engaged detents each further comprise:

a biased tab on the mount;

a boss proximate a distal end of the tab; and a well on the pin assembly adapted to mate with the boss to releasably retain the pin assembly in the stowed and engaged positions, respectively.

24. The combination of claim 19 further comprising:

an impact means on the pin assembly for being struck with a tool to dislodge the pin assembly from the engaged position.

25. The combination of claim 19 wherein the mount further comprises:

a base fixed to the panel; and a carrier removably mounted to the base.

26. The combination of claim 19 wherein the pin assembly further comprises:

a slide coupled to the mount for movement relative to the first hole; and a pin on the slide.

27. The combination of claim 25 wherein the engaged, stowed and retracted positions are linearly arranged with the retracted position being spaced a greater distance from the marginal frame than the stowed position which is spaced a greater distance from the marginal frame than the engaged position.

28. The combination of claim 19 further comprising:

an impact mast on the pin assembly adapted to be struck with a tool to dislodge the pin assembly from the engaged position;

wherein the impact mast projects upwardly from the pin assembly beyond the mount to provide convenient access for being struck.

29. The combination of claim 19 wherein the alternate latching mechanism is inserted through the aligned and first holes to couple the panels together in a direction opposite to an insertion direction of the pin assembly of the primary latching mechanism through the first and aligned holes to couple the adjacent panels together.

* * * * *